US005445719A

United States Patent [19]

Boiko

[11] Patent Number: 5,445,719

[45] Date of Patent: Aug. 29, 1995

[54] CORROSION CONTROL OF DISSIMILAR METALS

[76] Inventor: Robert S. Boiko, P.O. Box 544, Northbrook, Ill. 60065-0544

[21] Appl. No.: 249,228

[22] Filed: May 25, 1994

Related U.S. Application Data

[60] Division of Ser. No. 8,070, Jan. 22, 1993, Pat. No. 5,342,493, which is a continuation of Ser. No. 506,698, Apr. 9, 1990, abandoned, which is a continuation-in-part of Ser. No. 326,361, Mar. 21, 1989, abandoned.

[51] Int. Cl.[6] ..... G01N 27/26; C23F 13/00

[52] U.S. Cl. ..... 204/153.1; 204/147; 204/148; 204/153.11; 204/404

[58] Field of Search ..... 204/153.1, 153.11, 404, 204/147, 148, 196, 197

[56] References Cited

U.S. PATENT DOCUMENTS 1,020,480 3/1912 Cumberland ..... 204/196
3,055,813 9/1962 Schaschl et al. ..... 204/196
3,649,492 3/1972 Marsh et al. ..... 204/153.11
4,351,703 9/1982 Winslow ..... 204/153.11

OTHER PUBLICATIONS

Applegate, *Cathodic Protection*, 1960, pp. 5–24.

*Primary Examiner*—T. Tung
*Attorney, Agent, or Firm*—Emrich & Dithmar

[57] ABSTRACT

A corrosion inhibiting system for protecting joined dissimilar metals which are contacted by an electrolyte includes an anode electrode located in the electrolyte and adjacent to the less noble metal, and a cathode electrode connected to the more noble metal, the anode electrode and the cathode electrode being connected to the positive output and negative output, respectively, of a source of direct current for causing a direct current to flow through the joined dissimilar metals to inhibit the flow of corrosion producing local current between the dissimilar metals. The corrosion inhibiting system is employed in a hot water heater having a glass lined steel tank with a copper bottom head.

6 Claims, 3 Drawing Sheets

CORROSION CONTROL OF DISSIMILAR METALS

RELATED APPLICATION

This is a divisional of application Ser. No. 08/008,070, filed Jan. 22, 1993, now U.S. Pat. No. 5,342,493, which is a continuation of application Ser. No. 506,698 filed Apr. 9, 1990, now abandoned, which was a continuation-in-part of Ser. No. 326,361, filed Mar. 21, 1989, now abandoned.

BACKGROUND OF THE INVENTION

This invention relates to corrosion protection systems, and more particularly to corrosion protection systems for joined dissimilar metals which are employed in an aqueous environment.

Potable water, or similar type electrolyte normally contains certain corrosion causing components such as dissolved oxygen. Other oxidizing components of many varieties can be present in this medium, depending on the particular sample of water, the location from where the water was obtained as a geological function, certain water treatments such as softening, and the many other variable conditions to which water can be subjected.

It is common for potable water and other types of water systems to contain iron or iron bearing alloys which can form a galvanic corrosion cell between the iron bearing material and each oxidizing atom or molecule involved in a like reaction. These reactions can reach factors of $10^{(x)}$ per square inch. Therefore, it has not been possible to render each separate corrosion cell inactive by direct action to each oxidizing atom or molecule.

Cathodic protection systems have been developed to reduce corrosion caused by oxidizing components found distributed in the potable or similar type water containing the vulnerable metal. In a cathodic protection system, the vulnerable metal is electrically charged by a variable or constant voltage in order to cause the formation of a monatomic hydrogen layer. This hydrogen layer, when undisturbed, forms an interface between the oxidizing components and the vulnerable metal. In a passive environment where little or no turbulence exists, as well as other factors which would have an effect upon the integrity of the monatomic hydrogen layer, this form of protection can be useful in the reduction of corrosion cell formation from the waterborne corrosion inducing components. Cathodic protection is even more effective when the base metal is coated, such as with glasslining, cement or epoxy, reducing the contact area between the vulnerable metal and the aqueous medium.

However, impressed cathodic protection is not as effective and can actually accelerate corrosion in certain aggressive environments. Examples are an environment where there is turbulent water flow against the vulnerable metal removing the hydrogen layer and leaving a charged surface, or an environment characterized by elevated temperature, pH extremes, or contact of the vulnerable metal with a more noble dissimilar metal.

For dissimilar metal junctions, it can be shown that impressed cathodic protection of the vulnerable metal will accelerate the corrosion of the vulnerable metal by 20% to 45% or more when any significant turbulence is present. Naturally occurring cathodic protection that occures between joined dissimilar metals will cause only slight corrosion rate reductions in a low temperature environment, about 23° Centigrade where very little to no turbulence is present, and the water sample is non-aggressive, tap water, untreated at point of use.

The major water heater manufacturers have long recognized the shortfall of cathodic protection against dissimilar metal junctions and consequently avoid the use of dissimilar metal junctions in commercial units. Many water heater tanks have di-electric inlet and outlet factory attachments. Thermostat copper and brass shanks, as well as relief valve probes, are plastic coated. Drain valves are plastic, instead of copper or brass whenever possible. Copper electric heating elements are tin coated. Also, the new class of heating elements are now commonly produced. These heating elements are comprised of stainless steel or an iron alloy called Incolloy which further reduces dissimilar metal corrosion. Plumbing codes almost always specify that di-electric unions must be used when copper pipe is run to and from a hot water heater.

Various methods have been proposed to prevent corrosion. For example, L. Applegate, *Cathodic Protection*, McGraw Hill, February 1960, pp 1–28, discloses a method to stop the reaction between separate bars of copper and iron which involves application of an impressed current to the dissimilar metals. However, this method as disclosed by Applegate only has a laboratory application. The metals are never directly joined. Furthermore, the positive current electrode is connected directly to the more noble copper bar which causes the copper to become very active and disintegrate. Moreover, Applegate discloses that the accepted conclusion is that dissimilar metals should not be used due to the unpredictable nature and widespread potential for system corrosion.

SUMMARY OF THE INVENTION

The present invention provides a useful method for controlling corrosion of dissimilar metals such as those metals used in potable water or similar type environments. The invention allows these metals to be joined directly without the need for di-electric insulation by effecting the corrosion current flowing from the more vulnerable to the less vulnerable metal in this single corrosion cell. In systems where two dissimilar metals are joined, there is only one corrosion cell which can be treated in a different manner than the $10^{(x)}$ corrosion cells formed per square inch between a vulnerable metal and electrolyte containing oxidizing atoms or molecules, each forming an independent corrosion cell.

The invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

DESCRIPTION OF THE PREFERRED EMBODIMENTS

Figure 1:
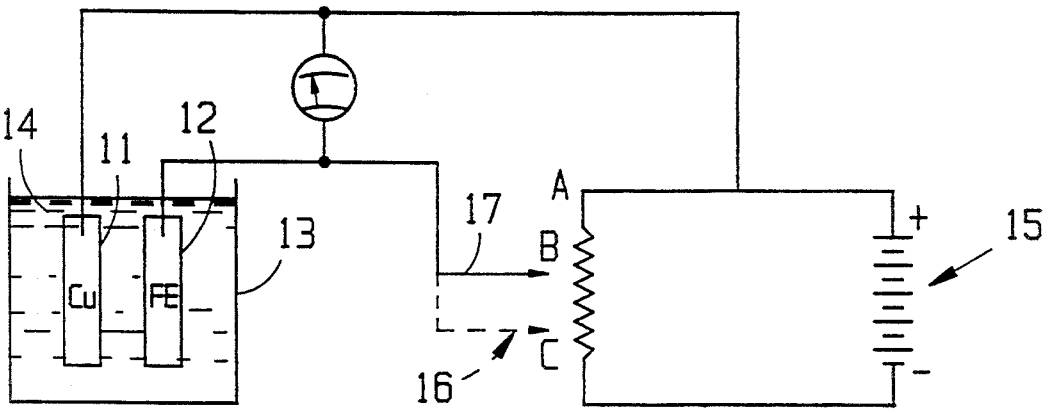
FIG. 1 PRIOR ART
FIG. 1, which is labeled Prior Art, is a simplified representation of a known arrangement for controlling electrolytic cell action using impressed current.

The use of impressed current for the purpose of corrosion protection of dissimilar metals is known and has been described, for example, by L. Applegate, in *Cathodic Protection*, McGraw Hill, 1960, pp 1–28. A diagrammatic representation of the control of cell action as reported by Applegate is illustrated in FIG. 1, which is labeled "Prior Art". The cell, illustrated in FIG. 1, is composed of a half cell of copper 11 and a half cell of iron 12, where the more noble electrode is copper and the less noble electrode is made of iron, which is a more active metal. The two electrodes 11 and 12 are disposed in a containment vessel 13 spaced apart from one another. The vessel is filled with a suitable electrolyte such as impure water 14. A battery of cells 15, capable of supplying a voltage greater than the 0.777 volts of the copper-iron cell, is connected to a slide wire voltage divider 16 and to the copper-iron cell. The positive battery terminal is connected directly to the copper electrode 11. The negative battery terminal is connected directly to the iron electrode 12. If the slide 17 is at point A, the battery 15 will have no effect and the cell will proceed in the normal way to dissolve iron.

The reaction ideally can be stopped by moving the slide 17 to point B where the voltage potential between points A and B is equal to that of the cell. In reality, local action will prevent complete immunity to corrosion. However, the local action on the iron can be suppressed and practically stopped by increasing the voltage from the divider slightly by moving the slider 17 to some point C on the divider. This changes the condition or function of the iron from that of anode, that is, the less noble metal, to that of cathode, that is, the more noble metal. This is called cathodic protection of the iron.

Although Applegate teaches the mechanics of corrosion protection using impressed current, it is not possible for this method as taught by Applegate to be applied to situations where the elements of the cell must be joined or otherwise directly electrically connected together.

Figure 2:
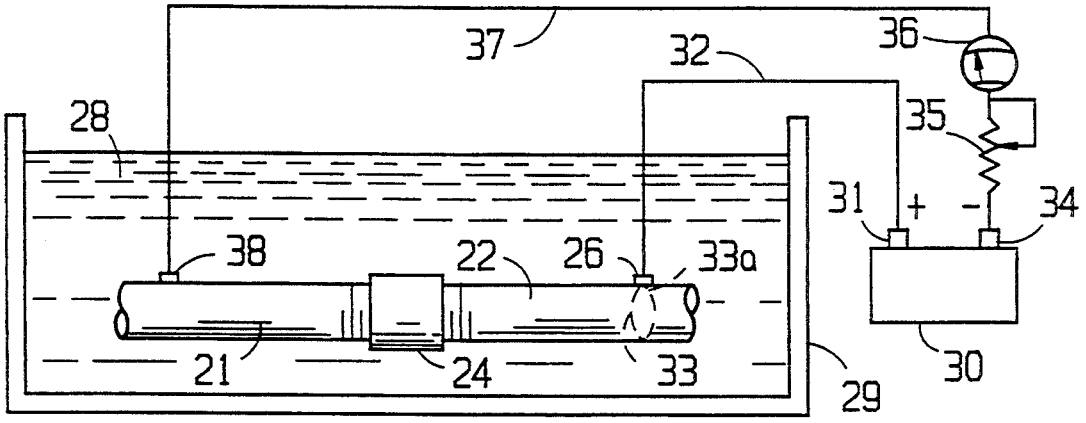
FIG. 2, is a simplified representation of a dissimilar metal corrosion protection arrangement applied to joined dissimilar metals which are immersed in an aqueous solution.

Referring now to FIG. 2, there is illustrated a simplified representation of a corrosion protection arrangement provided by the present invention which is applicable to joined or otherwise directly electrically connected together, dissimilar metals. In an exemplary embodiment, the metals include a copper element 21 and an iron element 22 joined together at an interface 24. However, the elements may comprise copper and its alloys and iron and its alloys, or other metals, depending upon the particular application in which the metals are employed. By way of illustrating the principles of the present invention, the copper element 21 and iron element 22 are each a section of pipe four inches long and one-half inch in outer diameter. The pipe sections are joined together at 24. The joined dissimilar metals are disposed in a containment vessel 29 which contains a suitable aqueous liquid or electrolyte 28 which may be tap water, for example, of sufficient level to submerse completely the joined dissimilar metals. The interior walls of the containment vessel are made of or coated with an electrically non-conductive material. The joined pipe sections may rest on the bottom of the vessel provided the tank inner surface is of an electrically non-conducting material. Alternatively, the objects to be tested may be supported by a suitable support structure (not shown) of an electrical insulating material with the objects to be tested being secured to such structure by insulated metal wires or other means.

For the purpose of applying an impressed current to the joined dissimilar metal elements, there is provided a source 30 of non-pulsed continuous direct current, such as a battery having a positive terminal 31 connected by a lead 32 to an anode electrode 33, and a negative terminal 34 connected through a variable resistor 35, an ammeter 36 and a lead 37 to a terminal 38 which is located on the outer surface of the copper element 21. The leads may be secured to the pipe sections by gold plated alligator clips or other similar devices. Any connection method of this type which allows for long term stable conductivity at the connection points may be employed.

The anode electrode 33 is in the form of a loop located within and conforming to but spaced from the inner surface of the iron element 22. A selected current value is applied to the cell to block the corrosion current and compensate for stray current leakage directly from the copper element 21 to the positive electrode via the water 28.

In the present example, it is assumed that the metal elements 21 and 22 comprise complementary threaded pipe sections to facilitate the interconnection at the juncture 24. The terminal 38 for the copper pipe 21 is located at the farthest feasible placement from the junction 24 so that the current applied will flow through substantially the entire copper element 21 toward the junction 24.

Figure 3:
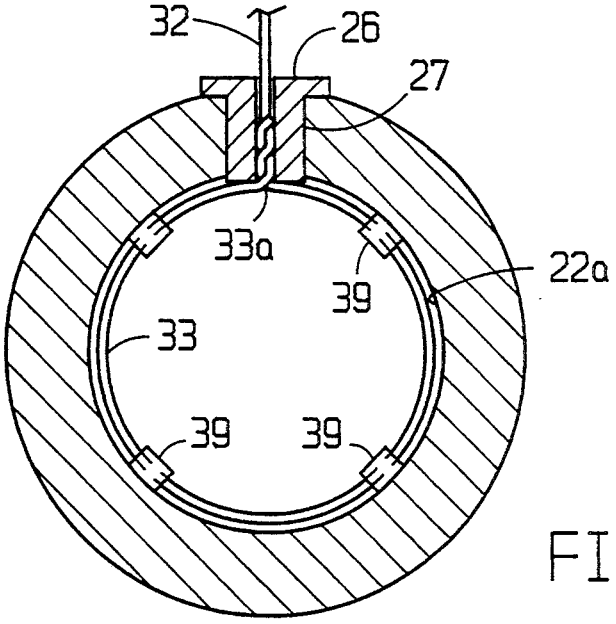
FIG. 3 is an enlarged sectional view taken along the lines 3—3 of FIG. 2.

Referring to FIGS. 2 and 3, the anode electrode 33 comprises a loop of gold or other suitable very noble, electrically conducting metal which is positioned at the farthest feasible placement from the junction 24. The anode loop is formed to follow the entire contour of the inner surface of the iron pipe 22, but not directly contacting the surface of the iron pipe. The anode loop 33 can be held in position using ceramic spacers 39 attached to the inner surface of the pipe sections using an epoxy glue or the like. Other similar support methods, or the use of a rigid hardened anode wire could also be employed. The ends of the loop are twisted together at 33*a*, and soldered or in some manner permanently joined at a point out of the aqueous environment, to the lead 32 which may be the same metal as the loop 33 or of a different composition, such as silver or copper wire insulated as needed. The terminal end 33*a* of the loop 33 extends through a suitable insulating member 26, such as a ceramic bushing. The insulating member 26 is located in an opening 27 through the iron pipe 22.

The loop which forms the anode electrode 33 is spaced from the inner surface 22*a* of the iron pipe so that current flows from the inner surface of the pipe through the water 28 to reach the anode electrode 33. By way of illustration, the loop 53 which forms the anode electrode 33 is spaced approximately one centimeter from the inner surface 22*a* of the iron pipe 22.

With the anode electrode 33 located remote from the junction 24 as illustrated in FIG. 3, cathodic protection of the iron pipe 22 is provided in addition to corrosion protection for the cell which is formed by the copper pipe 21 and the iron pipe 22.

Importantly, the protection arrangement of the present invention enhances the protection of both the weaker or less noble metal iron, and the stronger or more noble metal copper, because both metals receive the same negative current. Both metals also attain cathodic protection as a secondary benefit due to the passage of a negative direct current from the copper 21 and iron elements 22 through the water to the positive anode.

Establishment of the range of the reaction is important when determining electrical placements in objects which are larger in size than the reaction range. For example, for a cell having a twenty meter length including a ten meter length of copper pipe and a ten meter length of iron pipe, by the termination of a reaction range of four meters, the counterelectromotive force return path blocking current could be established within an eight meter length. This would reduce the current required to provide the corrosion protection. Moreover, it is important to introduce the neutralizing current into the circuit at the farthest point from the junction of the dissimilar metals. This is because this whole length of current travel through the copper element reduces the chances of a corrosion cell establishing between the copper which has not been modified for return path flow within the reaction range and the iron. This would be especially true for a path through the iron element where current is not drawn through to the end point in the iron pipe, as when the anode electrode 33 is located close to the junction area 24.

In accordance with the invention, the less noble metal iron is not connected directly to the negative terminal of the current source as is conventional in the art, as exemplified by Applegate, for example, but rather through the more noble metal copper which is joined to the less noble metal iron. That is, the copper element is connected to the negative terminal. Therefore, current is drawn through the copper element the iron element via anode electrode 33 which is spaced apart form the iron element and is connected to the positive terminal of the source 30. The anode electrode 33 is electrically insulated from direct contact with the iron element by a suitable insulating member 26. Moreover, the two dissimilar metals are joined together without any dielectric or other insulating means, there being a direct electrical connection between the two metals at the junction 24.

The method and corrosion control arrangement provided by the present invention is particularly useful in applications in which two dissimilar metals cannot be separated from one another by way of a dielectric and thus must be connected directly together. The method and arrangement provided by the present invention includes applying a DC voltage across the two metal elements, causing a continuous, non-pulsating DC current to flow through the two metal elements. The negative terminal of the source of current is connected directly to the more noble metal and the positive terminal of the source of current is connected to an anode electrode that is spaced apart from the less noble metal. Negative current flows from the negative terminal of the source 30 through conductor 37 to the more noble metal and is drawn through the aqueous solution to the anode 33 which is connected to the positive terminal of the source 30. A portion of the current path includes the aqueous solution because of the spacing between the anode electrode 33 and the surface of the less noble element 22.

Figure 4:
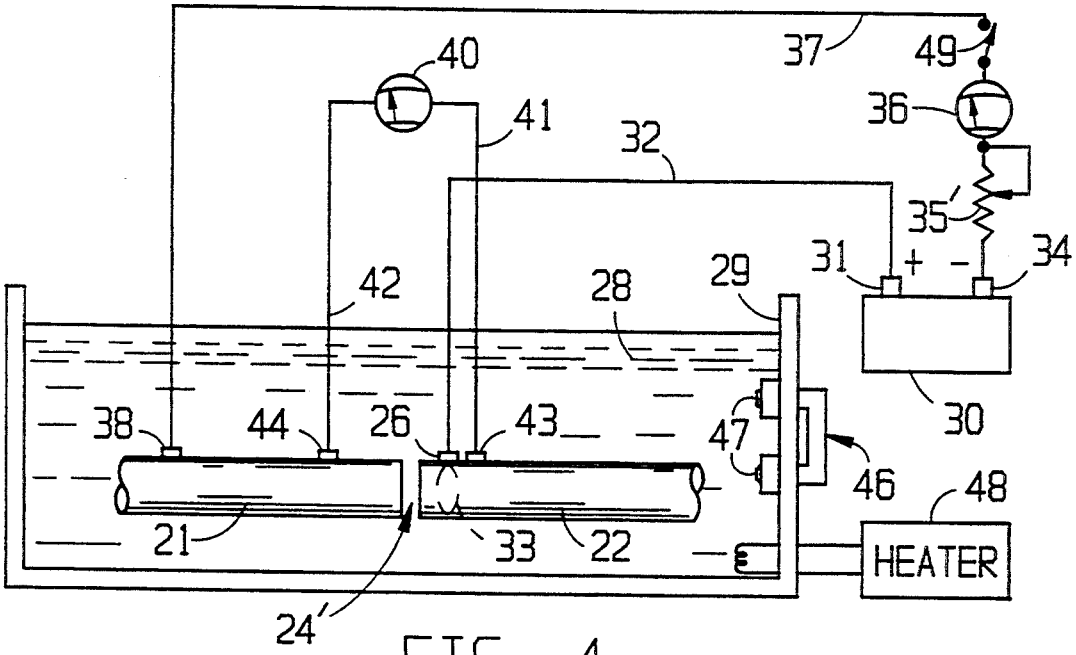
FIG. 4 is a simplified representation of an arrangement for providing corrosion protection of dissimilar metals in accordance with the present invention.

Referring now to FIG. 4, for the purpose of further illustrating the principles of the present invention and the manner in which the value of impressed current is determined, there is shown a cell comprised of separate metal pipes of copper 21 and iron 22 spaced apart defining a junction area 24' therebetween. Preferably, the current measuring meter 40 should have an impedance of 20 megohms or more. The dissimilar metal elements are placed as closely together as possible without directly touching, during the test period. Since a high impedance meter will shunt virtually all of the current directly through, the readings are accurate to a high degree and closely approximate the current required when the metal elements are joined and connected directly together. Battery 30 provides a source of current for neutralizing the electron current produced as a result of cell action. Normally open switch 49 is operable to connect the battery in circuit with the cell. In the example illustrated in FIG. 4, the anode 33 is located close to the junction area 24'. With this arrangement, a lower value of impressed current is required, but cathodic protection is not provided for the iron pipe 22. By way of example, the anode 33 may be located within about five centimeters from the design junction area 24'.

In normal use, certain surfaces of the iron pipe section 22 would not be contacted by water because they would be coated such as by glasslining when the cell represents a water heater. Such surfaces coated with a No. 14 wax or other temperature-stable nonelectrically conducting coating for the procedure for determining the value of impressed current needed to provide corrosion protection. The entire outer surfaces must be coated, because if left uncoated, this will affect the value of current that has to be applied. As a rule, non waterside surfaces which will be in contact with the water in the test phase will be coated. Glasslined objects such as that part of a water heater tank would be tested with a representative glasslining. This coating is somewhat porous and would allow current flow between the anode loop and the dissimilar metal. Similarly, the less active, more noble copper pipe 21 has its non-water contacting surfaces coated with wax or a temperature-stable nonelectrically conducting coating. The internal surfaces of the two pipes 21 and 22 are not coated with any current altering wax or other substance beyond those representative of permanent design coatings, such as glass lining in an actual unit. The adjacent ends of the two pipes 21 and 22 are positioned as close as possible but without physically touching one another to the extent that an electrical current could electrically migrate between the two pipe sections. A further ammeter 40 is connected by conductors 41 and 42 to terminals 43 and 44, respectively, of the iron pipe section 22 and the copper pipe section 21. The ammeter 40 preferably has a greater than 20 megohm impedance and proper scale resolution such as microamps or milliamps.

An aerator 46 is mounted on the containment vessel 29 and includes a plurality of pressure jets 47 or other velocity producing device, located within the vessel and which can cause a turbulent condition approximately three meters per second, variable on demand, so that secondary hydrogen coatings formed during the corrosion current quantification are removed, leading to stability of the current measured by current meter 36. Different velocities may be used, if necessary, to obtain a stable reading on the ammeter 36. Also, a heating unit 48 is provided for maintaining the water at the highest anticipated "use" temperature to duplicate actual design use or worst case temperatures.

with the copper pipe 21 and iron pipe 22 section positioned within the containment vessel 29 and the ammeter 36 connected in circuit with the battery and the pipes 21 and 22 as illustrated in FIG. 4 and with ammeter 40 connected between the two pipes 21 and 22, the containment vessel 29 is filed with an aqueous solution 28. The aerator 46 is activated to generate turbulence from its pressure jets 47 and the heater 48 is energized to increase the temperature of the aqueous solution to a desired value. Turbulence from the pressure jets will cause hydrogen coatings formed during the corrosion current quantification to be removed as indicated by a stabilized value on the ammeter 40.

It is assumed initially that the switch 49 is open so that the battery 30 is disconnected from the cell.

The switch 49 is then closed, with the variable resistor 35' initially set to its highest resistance value. This permits negative current to flow through resistance 35, ammeter 36, switch 49 and the conductor 37 to the pipe section 21 which is the more noble less active metal, through the pipe section 21 to the junction area 24', through the more active, less noble metal 22 and through solution 28 to the anode electrode 33 and to conductor 32 to the positive terminal 31 of the battery. The variable resistor 35' is adjusted gradually, decreasing its resistance, increasing the current in circuit path until the current registered by ammeter 40 decreases to zero.

By way of example, in one test which was conducted using pipes each one-half inch in diameter and four inches in length, the initial reading for ammeter 40 was 1.7 milliamps. When the reading of ammeter 40 was reduced to zero through the introduction of impressed current, ammeter 36 read 2.9 milliamps, this being the amount of compensating current required to block the corrosion current while providing compensation for stray current leakage directly from the copper element to the positive electrode via the aqueous solution or other deviations in the electrical path.

Figure 5:
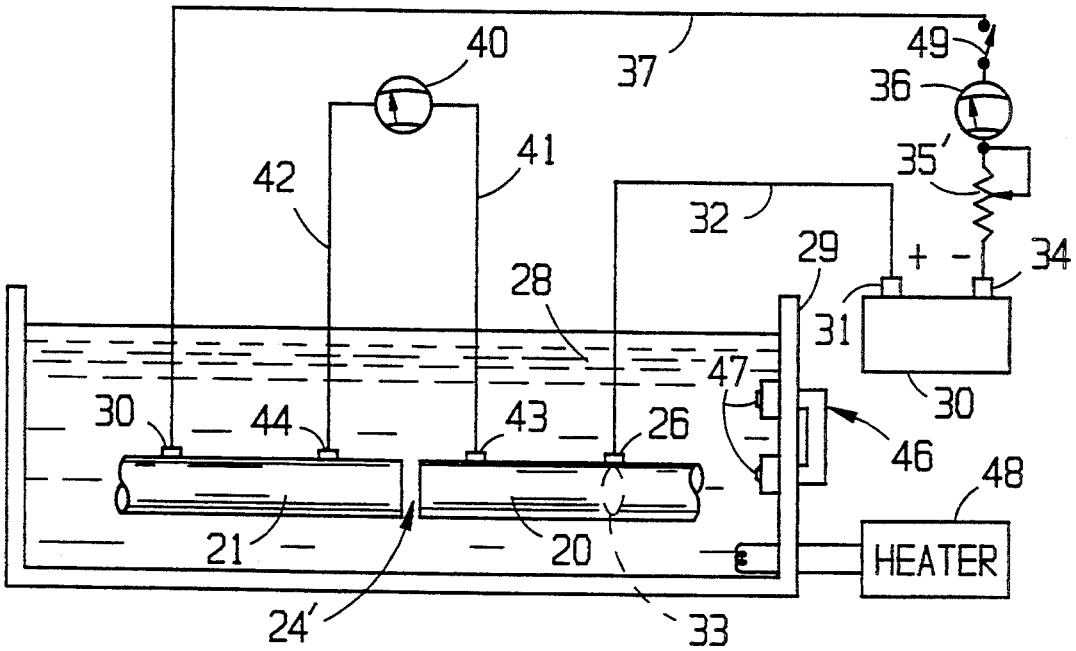
FIG. 5 is an illustration similar to FIG. 4 but with one of the electrodes located remote from the juncture area of the dissimilar metal for providing cathodic protection in addition to corrosion protection.

Referring to FIG. 5, the anode electrode 33 may be positioned remotely from the junction area 24'. In such case, there is more current flow through a greater extent of the iron pipe 22, providing cathodic protection in addition to corrosion protection. However, it is apparent that a greater value of compensation current will be required if the electrode 33 is placed farther from the junction area to allow for current density per square inch consistent with cathodic protection of the structure. Thus, the arrangement of FIG. 5 improves secondary cathodic protection by drawing more current through more of the iron pipe surface while allowing for proper current distribution in even manner to assure complete blockage of corrosion currents. The arrangement illustrated in FIG. 4 localizes the cathodic protection near the junction area because more of the externally applied current is drawn out before it reaches the portions of the iron pipe remote from the junction area 24.

The foregoing tests can be run over a period of weeks or longer to determine stabilities. However, the water sample must be monitored for continued representation with actual planned usage conditions. When the copper pipe 21 and iron pipe 22 are joined directly together, with the ammeter 40 disconnected and removed from the circuit, the corrosion current from the more active metal to the less active, more noble, metal will continue to be zero because the impressed current will overcome the corrosion current. Moreover, a suitable compensating circuit (not shown) may be incorporated into the corrosion protection system to regulate the amplitude of the corrosion protection current to maintain a desired potential.

In the final form, the measurement obtained for ammeter 36 is the current needed to provide corrosion protection for the copper pipe 21 and iron pipe 22 when connected together physically to prevent dissimilar metal corrosion as could otherwise be caused by the aqueous environment. It is important that the position of the positive anode 33 be maintained because the current will vary as a function of the positioning of this electrode 33.

Figure 6:
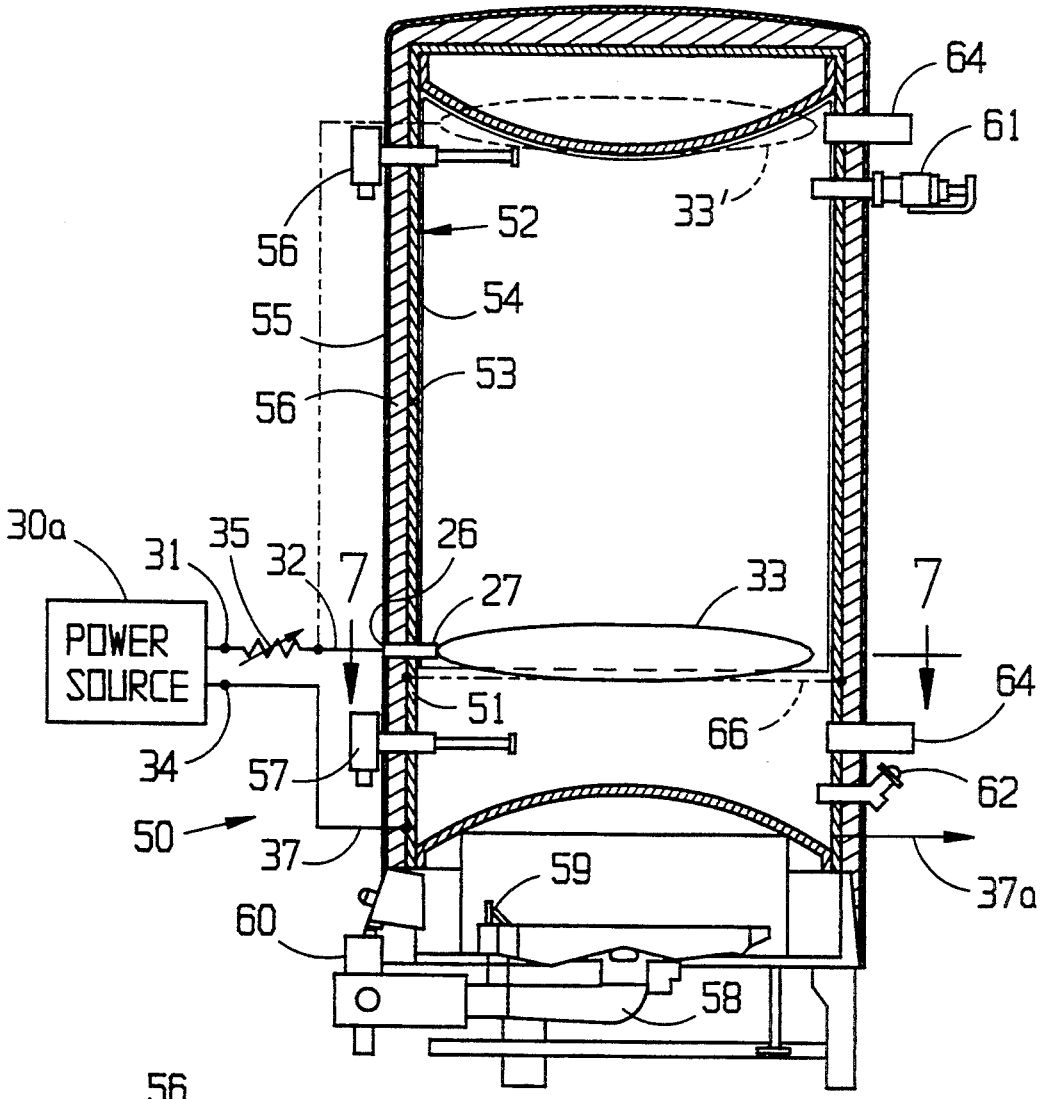
FIG. 6 is an elevational view in section of a water heater incorporating the corrosion protection arrangement of the present invention.
Figure 7:
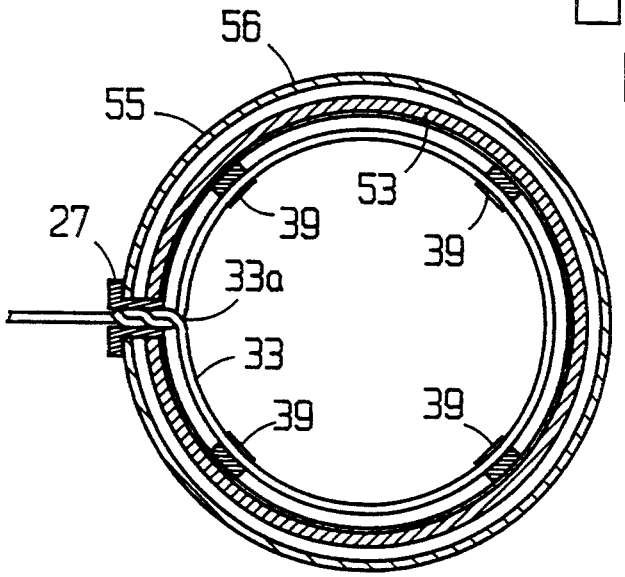
FIG. 7 is a sectional view taken along the lines 7—7 of FIG. 6.
Figure 8:
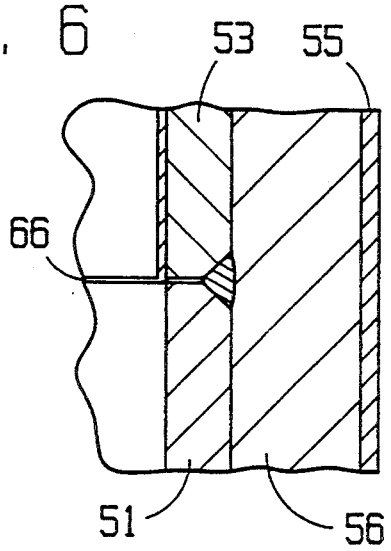
FIG. 8 is an enlarged, fragmentary view illustrating the junction between the dissimilar metals of water heater.

Referring to FIGS. 6, 7 and 8, the corrosion protection method and apparatus of the present invention is illustrated employed in a hot water heater indicated generally at 50 for providing corrosion protection for joined dissimilar metals, including a copper bottom head 51 and a glasslined steel portion 52 of the tank. By way of example, a known hot water heater, for example Rheem Models G84-G126, G168-G202, is refitted with a copper or similar heat conductive bottom portion 51 as shown in FIGS. 6–8. The neutralizing current is then applied as described. The hot water heater is of a floater design, which means it has no internal flue structure. This modified floater tank design has fewer welds than a conventional tank with internal flues, thereby making this tank less prone to leakage which could result from thermal stress to the unit. The inclusion of the copper bottom head results in a tank having a thermal efficiency that will meet with government approved standards that results in part from the fact that the copper bottom head does not have to be glasslined or otherwise coated providing better heat transfer through the metal. The flame heat is absorbed through the bottom head 51 and the tank walls 53 which are made of steel and coated with glass 54 to provide the glasslined tank structure 52. It is not necessary that the copper bottom head be glasslined or otherwise coated. However, a glass lining or other coating could be provided on the copper bottom head. The glasslined tank is enclosed within a jacket 55 with insulation 56 located between the outer jacket 55 and the glasslined tank 52 as is noted above. The hot water heater includes an upper thermostat 56, a lower thermostat 57, a burner 58 having a pilot/thermocouple unit 59 and a valve arrangement 60 for supplying fuel to the burner and pilot. A relief valve 61 is provided near the upper portion of the tank which has a drain cock 62 near its bottom and suitable input- /output nipples 64 are provided for connection to exterior hot water receiving apparatus (not shown).

In accordance with the invention, the positive terminal 31 of a power source 30*a* is connected through a resistor 35 and conductor 32 to a positive or anode electrode 33, which is a loop of gold wire or other noble electrically conducting metal, the conductor 32 passing through a suitable insulating and water-tight bushing 26 which passes through the side wall of the tank. The negative terminal 34 of the power source 30*a* is connected through conductor 37 to the copper bottom head 51 which is welded to the steel tank 53 at junction area 66, as shown best in the enlarged fragmentary view of FIG. 8. A second electrical connection is provided at 37*a* between the negative terminal 34 of the power source 30*a* and the copper bottom head 51. The use of two points of entry ensures more even electron distribution. It is apparent that even more points could be used to connect the negative terminal 34 with the copper bottom head 51.

A current decrease is expected and proper when the steel tank is coated, especially with glasslining. However, glasslining is porous. This is why cathodic protection is currently used in water heaters with glasslined steel tanks. Protection of the exposed steel is necessary. A decrease in neutralizing current will be noted. However in the design of a tank, or other structure containing coated waterside parts such as glasslining, the value of the neutralizing current must be selected to compensate for the fact that these coatings tend to degrade over time and expose areas of the base metal. Preferably the neutralizing current values are determined for conditions of degraded coatings and those values employed for establishment of long term protection.

While in the exemplary embodiment the anode electrode 33 is located close to the junction area 66, it is apparent that the anode electrode could be located as electrode 33' remote from the junction area 66 in which case cathodic protection will be provided for the steel tank in addition to dissimilar metals corrosion protection.

I claim:

1. A method for determining the value of neutralizing current that is required to inhibit the flow of corrosion current between first and second dissimilar metal portions which when joined at a junction area form a metal structure which is contacted by an electrolyte and for protecting said structure, said method comprising: monitoring the amplitude of corrosion current flowing between the first and second dissimilar metal portions using a first current measuring means, said metal portions being spaced apart, locating an anode electrode in the electrolyte adjacent to but spaced apart from a less noble metal portion of the dissimilar metal portions, connecting a cathode electrode to a more noble metal portion of the dissimilar metal portions remote from the junction area, applying a potential difference across the junction area of the dissimilar metal portions by connecting the anode electrode and the cathode electrode to positive and negative outputs respectively of a source of non-pulsating direct current to cause a neutralizing current to flow between the first and second metal portions, monitoring the amplitude of the neutralizing current flowing between the first and second metal portions using a second current measuring means, increasing the potential difference across the junction area of the dissimilar metal portions to increase the amplitude of the neutralizing current until the amplitude of the corrosion current measured by the first current measuring means is decreased to zero to determine the value of neutralizing current required to inhibit flow of corrosion current, then connecting said metal portions to form the metal structure and applying neutralizing current at said value to the metal structure.

2. The method according to claim 1 which includes locating the anode electrode near the junction area.

3. The method according to claim 1 which includes locating the anode electrode remotely from the junction area.

4. The method according to claim 1, further comprising causing turbulence in the electrolyte during determination of the value of the neutralizing current.

5. The method according to claim 1, wherein the less noble metal is in the shape of a conduit and said anode electrode is a loop defining a plane perpendicular to the longitudinal axis of the less noble metal conduit.

6. A method for determining a neutralizing current that is required to inhibit the flow of corrosion current between generally cylindrical first and second dissimilar metal portions connected to form a metal structure in contact with an electrolyte comprising: providing a containment vessel, providing in said vessel an electrolyte of substantially the same composition as that of said first mentioned electrolyte, causing a turbulent flow of the electrolyte within the containment vessel, raising the temperature of the electrolyte in the vessel to a desired value, placing first and second spaced apart, generally cylindrical, dissimilar metal portions within the containment vessel, one of mid portions being more noble than the other, measuring the corrosion current between said first and second metal portions with an ammeter connected in a series circuit attached to the first and second portions having a polarity such that the corrosion current from the less noble metal portion to the more noble metal portion causes a reading above zero, placing an anode electrode in said vessel positioned close to the less noble metal portion, the anode electrode being substantially in the form of a loop defining a plane perpendicular to the longitudinal axis of the less noble metal portion, applying a potential difference between said anode electrode and the more noble metal portion as a cathode electrode to cause a neutralizing current to flow between said metal portions, providing a second ammeter and a variable resistor for the neutralizing current, and adjusting the amplitude of the neutralizing current with said variable resistor until the corrosion current flow measured by said first mentioned ammeter drops to zero, the second ammeter providing a measure of the value of neutralizing current required to inhibit the flow of corrosion current.

* * * * *

UNITED STATES PATENT AND TRADEMARK OFFICE

CERTIFICATE OF CORRECTION

PATENT NO. : 5,445,719
DATED : August 29, 1995
INVENTOR(S) : Robert S. Boiko

It is certified that error appears in the above-indentified patent and that said Letters Patent is hereby corrected as shown below:

Column 10,
Claim 6, line 39, delete "mid" and insert --said--。

Signed and Sealed this

Twenty-sixth Day of December, 1995

*Attest:*

Bruce Lehman

BRUCE LEHMAN

*Attesting Officer*

*Commissioner of Patents and Trademarks*